US008042370B2

(12) United States Patent
Szuba

(10) Patent No.: US 8,042,370 B2
(45) Date of Patent: Oct. 25, 2011

(54) FLOW FORMED GEAR

(75) Inventor: Joseph Szuba, Dearborn, MI (US)

(73) Assignee: Ronjo, LLC, Rochester Hills, MI (US)

( * ) Notice: Subject to any disclaimer, the term of this patent is extended or adjusted under 35 U.S.C. 154(b) by 0 days.

(21) Appl. No.: 11/703,611

(22) Filed: Feb. 7, 2007

(65) Prior Publication Data

US 2007/0251283 A1 Nov. 1, 2007

Related U.S. Application Data

(60) Provisional application No. 60/771,130, filed on Feb. 7, 2006.

(51) Int. Cl.
*B21D 22/14* (2006.01)
*B21K 1/30* (2006.01)

(52) U.S. Cl. ..... 72/83; 29/893.32

(58) Field of Classification Search ..... 72/82–86, 72/102, 96, 101, 365.2; 29/893.32
See application file for complete search history.

(56) References Cited

U.S. PATENT DOCUMENTS

| | | | |
|---|---|---|---|
| 4,023,389 | A | 5/1977 | Dibble et al. |
| 4,141,484 | A | 2/1979 | Hamilton et al. |
| 4,177,665 | A | 12/1979 | Schurmann |
| 4,563,887 | A | 1/1986 | Bressan et al. |
| 4,576,776 | A | 3/1986 | Anderson |
| 4,760,725 | A | 8/1988 | Halasz |
| 4,781,047 | A | 11/1988 | Bressan et al. |
| 5,344,508 | A | 9/1994 | Gilman et al. |
| 5,404,640 | A | 4/1995 | Himmeroeder |
| 5,509,290 | A | 4/1996 | Faivre |
| 5,676,007 | A | 10/1997 | Köstermeier |

(Continued)

FOREIGN PATENT DOCUMENTS

| | | | |
|---|---|---|---|
| EP | 0 245 049 | A1 | 11/1987 |

(Continued)

OTHER PUBLICATIONS

Machine Shop Work Article (Part IV), date unknown.

*Primary Examiner* — Debra Sullivan
(74) *Attorney, Agent, or Firm* — Howard & Howard Attorneys PLLC

(57) ABSTRACT

A method of forming a ring gear from a ring blank includes providing a mandrel having a central axis and an outer annular forming surface. The outer annular forming surface defines a plurality of forming elements having a forming element axis offset from the central axis of the mandrel. The ring blank has a ring axis and is placed over the mandrel generally aligning the central axis of the mandrel with the ring axis of the ring blank. A roll is provided having a roll axis that is generally parallel with the element axis. The roll is forced radially inwardly while circumscribing the central axis. The roll pivots around the roll axis deforming the ring blank radially inwardly forming teeth on an inner surface of the ring blank that coaxial with the element axis and offset from the mandrel axis.

7 Claims, 3 Drawing Sheets

U.S. PATENT DOCUMENTS

| | | | |
|---|---|---|---|
| 5,882,161 | A | 3/1999 | Birkelbach |
| 5,941,637 | A | 8/1999 | Maurer |
| 6,026,666 | A | 2/2000 | Zimmermann et al. |
| 6,136,387 | A | 10/2000 | Koizumi |
| 6,205,832 | B1 | 3/2001 | Köstermeier |
| 6,227,024 | B1 | 5/2001 | Köstermeier |
| 6,269,670 | B2 | 8/2001 | Köstermeier |
| 6,295,854 | B1 * | 10/2001 | Stein et al. ..... 72/96 |

FOREIGN PATENT DOCUMENTS

| | | | |
|---|---|---|---|
| EP | 0 245 050 | B1 | 11/1987 |
| EP | 0 649 355 | B1 | 4/1995 |
| EP | 0 739 454 | B1 | 10/1996 |
| EP | 1 389 501 | A1 | 2/2004 |

* cited by examiner

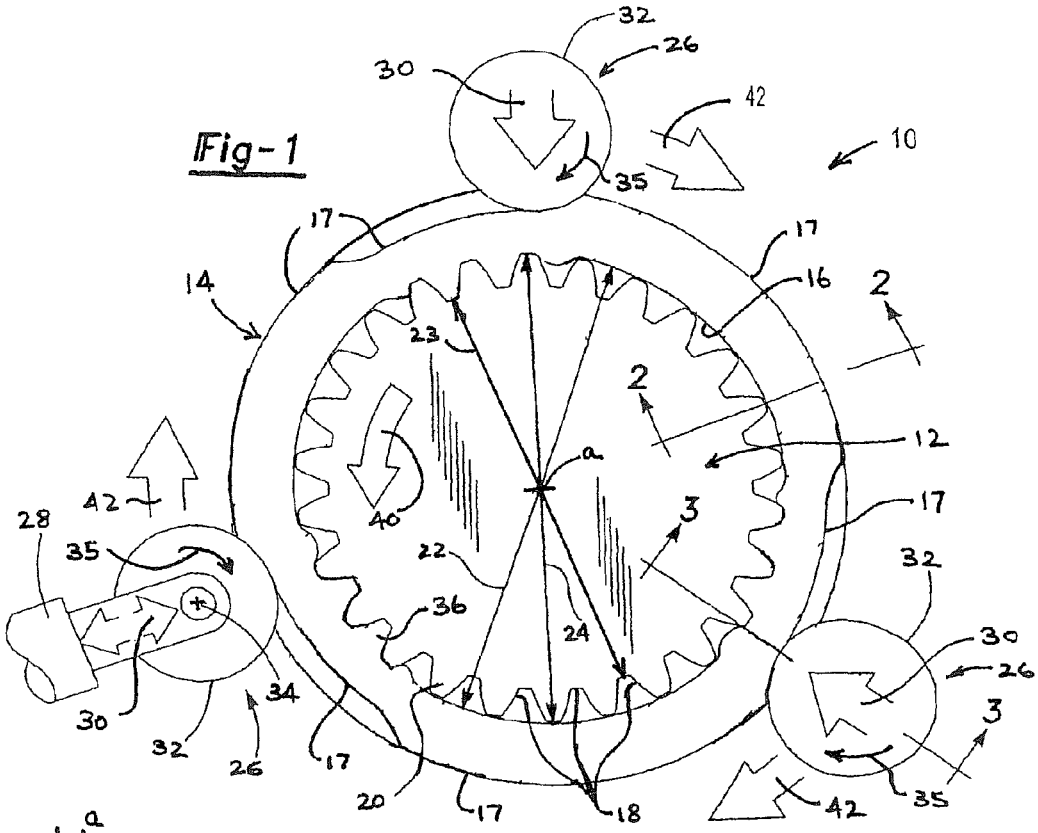
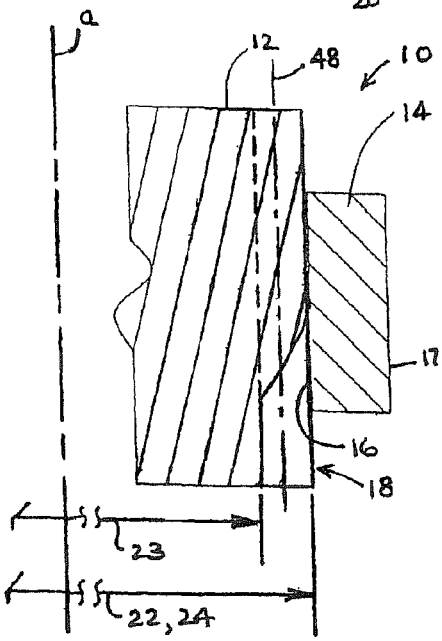
Fig-2
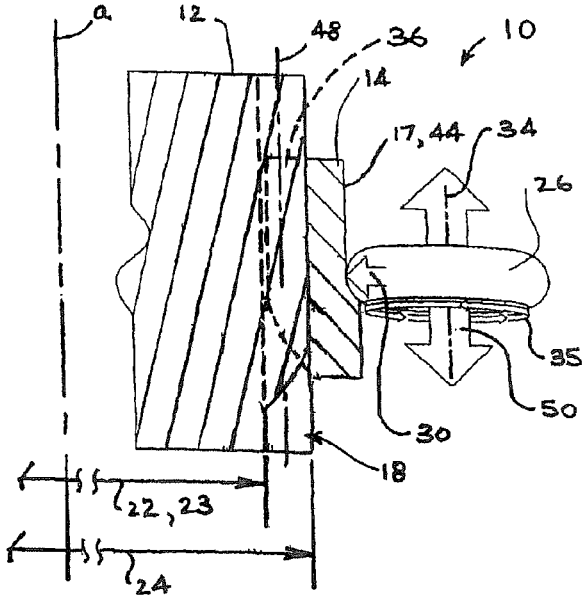
Fig-3

FLOW FORMED GEAR

RELATED APPLICATION

The present application claims priority to U.S. Provisional Patent Application No. 60/771,130 filed Feb. 7, 2006.

BACKGROUND OF THE INVENTION

This invention relates generally to methods of forming a ring gear. More specifically, this invention relates to methods of forming a ring gear having internal teeth without the use of machining operations.

Gears are widely used in the mechanical arts to transfer motive force between mechanical components. The gear typically includes gear teeth that engage teeth formed on a cooperable gear or mechanical device to transfer motive force between the two elements. Because the mechanical forces are substantial upon each of the gear teeth, a precise dimensional configuration or profile is required to provide a uniform engagement. This is particularly necessary for gears used in automotive transmissions. To achieve precise dimensional configuration, milling, broaching, and machining operations are generally performed on a gear blank to achieve necessary gear teeth profiles. Generally, teeth formations may be formed in the gear blank and then a subsequent machining operation is performed to provide precise dimensional characteristics necessary to withstand the high loads required of complex motive operations used, for example, in automotive transmissions.

Attempts have been made to cold work or flow form gear teeth profiles in simple gears starting from a blank without the use of additional machining operations. While flow forming and cold working have shown promise in eliminating the necessary machining operations, forming defects are prevalent, have heretofore reduced the ability to use gears having teeth formed only by cold working or flow forming in transmission operations. For example, a gear having angular or slightly helical teeth not parallel to a ring axis that have been formed by cold working or flow forming is known to have inconsistencies resulting from not fully filling mandrel formation elements used to form the gear teeth. Inconsistent forming of the gear teeth in a cold working or flow forming process results in mechanical failures in devices in which the gears are used. Thus, it has been necessary to machine gear teeth used in high speed high torque operations.

Therefore, it would be desirable to provide a method of forming defect-free gear teeth on a gear blank that does not require a secondary machining operation, yet enables the resultant gear to be used in a high speed high torque mechanical device.

SUMMARY OF THE INVENTION

The present application discloses a method of forming a ring gear from a ring blank. A mandrel having a central axis and an outer annular forming surface defines a plurality of forming elements each having a forming element axis that is offset relative to the central axis of the mandrel. The ring blank has a ring axis and is placed over the mandrel, generally aligning the central axis of the mandrel with the ring axis of the blank. A roll having a roll axis that is generally parallel with the forming element axis located between the central and roll axes is forced radially inwardly relative to the central axis while circumscribing the central axis. The roll rotates about the roll axis while being forced radially inwardly relative to the central axis, and deforms the ring blank radially inwardly toward the central axis, forming teeth on an inner surface of the ring blank that are parallel with the forming element axes and offset relative to the mandrel central axis.

Prior art flow forming techniques have used deformation devices that deform the ring blank over a mandrel or forming device configured to form gear teeth on the ring blank. Typically the device is a roll having an axis of rotation that is angularly aligned with the mandrel central axis regardless of whether the gear teeth are to be angularly aligned with the mandrel central axis. This results in inconsistency in the teeth formed in the gear blank because the forces necessary to deform the ring blank into the forming elements are not uniform. It has been determined by the Applicant that aligning the axis of the roll in a parallel relationship with the axis of forming element over which the roll is superposed and not with the mandrel central axis overcomes this deficiency in prior art flow forming techniques. This alignment allows for the complete elimination of any subsequent or secondary machining operations required to provide uniform, dimensionally accurate teeth on the ring gear.

BRIEF DESCRIPTION OF THE DRAWINGS

Other advantages of the present invention will be readily appreciated as the same becomes better understood by reference to the following detailed description when considered in connection with accompanying drawings, wherein:

FIG. 1 is a schematic representation of a partial plan view of the inventive flow forming method;

FIG. 2 is partial sectional view along line 2-2 of FIG. 1 showing a ring blank interacting with a mandrel forming element;

FIG. 3 is a partial sectional view along line 3-3 of FIG. 1, showing the ring blank being deformed radially inwardly relative to the mandrel central axis, and over and between the forming elements of the mandrel;

DETAILED DESCRIPTION OF THE INVENTION

Figure 4:
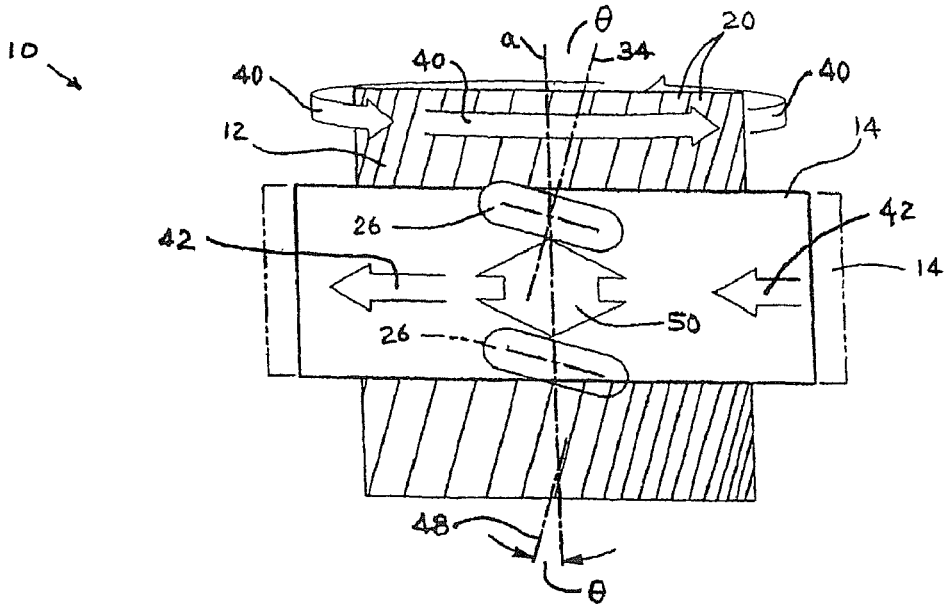
FIG. 4 is a schematic elevational view of the roll of the present invention deforming the ring blank radially inwardly.
Figure 5:
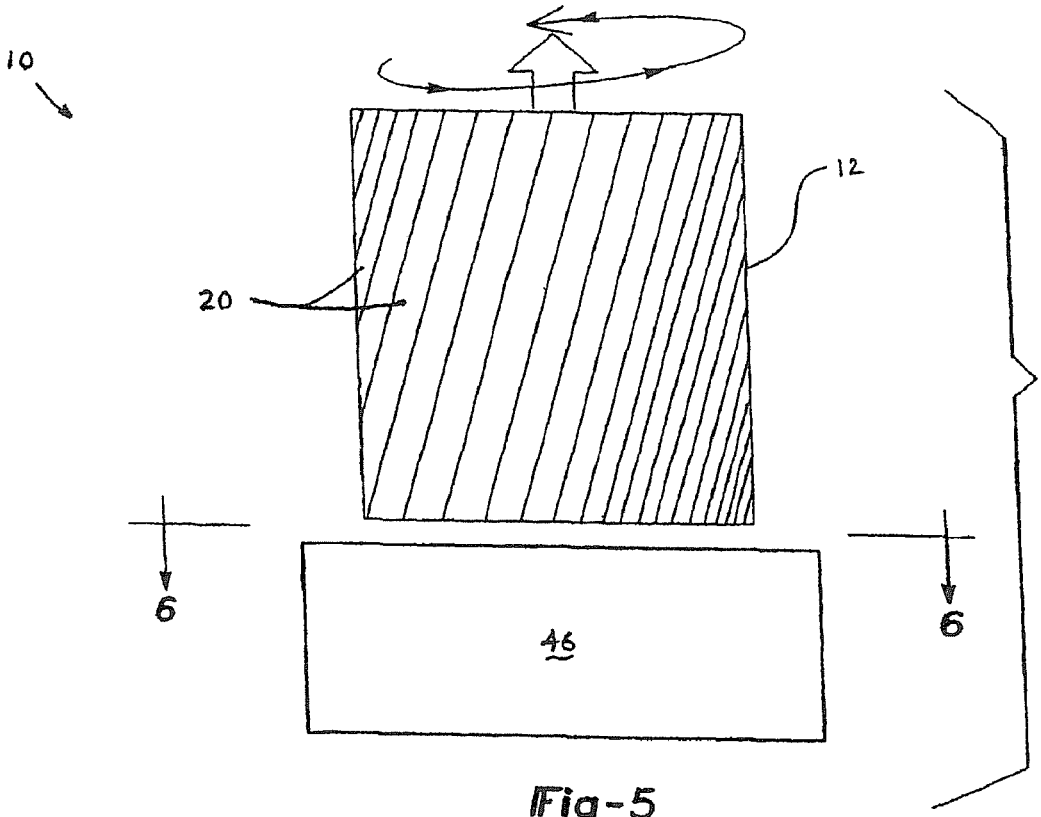
FIG. 5 is a schematic elevation showing the removal of the formed ring gear from the mandrel.

A schematic plan view of the forming assembly 10 is generally shown in FIG. 1. A mandrel 12 having a central axis a is shown, around which a ring blank 14 is disposed. The ring blank 14 includes an inner annular surface 16 that is smooth, and a concentric, smooth outer annular surface 17. Initially, ring blank inner and outer walls 16, 17 are cylindrical. The mandrel 12 includes radially inner and outer diameters 23, 24 between which is forming surface 18 that defines a plurality of forming elements 20. The forming elements 20 are angularly offset from the mandrel axis a as is best represented in FIG. 4 and will be explained further below.

The inner annular surface 16 of the ring blank 14 defines an inner diameter 22 that initially is generally equivalent to outer diameter 24 of mandrel 12 and a first extent of the forming elements 20. Therefore, the ring blank 14 is secured upon the mandrel 12 with an interference fit between the inner annular surface 16 of the ring blank 14 and the forming elements 20 of the mandrel 12. It should be understood by those skilled in the art that the ring blank 14 and the mandrel 12 have the same central axis a, or are otherwise coaxial. A roll 26 is mounted upon a drive 28 that provides force in a direction of arrow 30, driving the roll 26 radially inwardly toward mandrel axis a. The roll 26 is preferably a wheel 32 that rotates about roll axis 34 in the direction of arrow 35 along ring blank outer annular wall 17. Preferably, a plurality of rolls 26 or wheels 32 is provided to reduce the cycle time of the ring gear formation.

Figure 6:
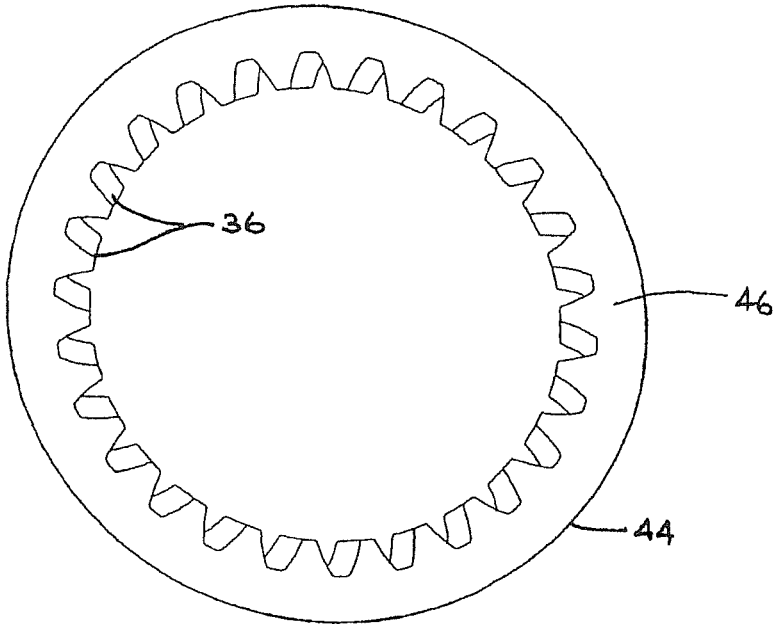
FIG. 6 is a plan view along line 6-6 of the ring gear of the present invention shown in FIG. 5.

As shown in FIG. 1, each roll 26 circumscribes the ring blank 14 while being forced radially inwardly by the drive 28 over and between the forming elements 20, reshaping the inner annular surface 16 of the ring blank 14 into a configuration defined by the forming elements 20 of the mandrel 12. The deformation of the inner annular surface 16 of the ring blank 14 forms gear teeth 36 associated with resulting gear 46 (FIG. 6). By driving the roll 26 radially inwardly relative to mandrel axis a, the outer diameter of the ring blank 14 is decreased as the gear teeth 36 are formed on the inner annular surface 16. The mandrel 12 rotates about mandrel axis a in the direction of arrow 40 while each roll 26 is forced radially inwardly toward axis a. Alternatively, the mandrel 12 is stationary while each roll 26 circumscribes the ring blank 14 in a direction of arrow 42. A still further embodiment is contemplated where the mandrel 12 rotates about mandrel axis a in a direction of arrow 40 while each roll 26 circumscribes the ring blank 14 in an opposite direction of arrow 42, further reducing cycle time.

FIG. 2 shows inner annular surface 16 of the ring blank 14 in an abutting relationship with a radially outermost portion of forming surface 18 located at diameter 24 on a forming element 20 of the mandrel 12, prior to forming gear teeth 36. FIG. 3 shows the ring blank 14 being deformed radially inwardly relative to axis a and over the forming element 20 of the mandrel 12 located between roll axis 34 and mandrel axis a, resulting in gear teeth 36 being formed on the inner annular surface 16 of the ring blank 14. The roll 26 articulates along roll axis 34 in the directions of arrow 50 (FIG. 3) while being forced radially inwardly toward mandrel axis a in the direction of arrow 30 to deform the ring blank 14 radially inwardly relative to axis a. Roll axis 34 is shown generally parallel to mandrel axis a. Furthermore, the roll 26 moves the full extent of the ring blank 14 so that the entirety of the ring blank 14 is forced radially inwardly to form a uniform outer annular surface 44 of a formed ring gear 46.

FIG. 4 shows a schematic side view of forming assembly 10 in which the roll axis 34 is shown angularly offset relative to the mandrel central axis a, as indicated by angle θ. The forming elements 20 each include a forming element longitudinal axis 48 that is also angularly offset relative to the mandrel central axis a, as also indicated by angle θ. The roll axis 34 and the longitudinal axis 48 of the forming element 20 interposed between roll 26 and mandrel central axis a are generally parallel, so that the radially inwardly directed force being applied to the ring blank 14 by the roll 26, as the roll 26 rotates in the direction of arrow 35 and circumscribes ring blank 14. Each roll 26 rolls along ring blank outer annular surface 17 in a direction of travel that is generally perpendicular to the axis 48 of each of the forming elements 20 disposed on the mandrel 12 as it is interposed between the roll 26 and mandrel central axis a; and therefore the direction of travel of the rotating roll 26 is also perpendicular to the longitudinal directions of gear teeth 36 being formed on the ring blank 14. While the roll axis 34 about which the wheel 32 rotates is generally parallel to the forming element axis 48, the articulating motion of the roll 26 in the directions of arrow 50 is generally parallel to the mandrel central axis a. The resultant ring gear 46 shown in FIG. 6 has provided advantages not known in the prior art relating to formed ring gears due to the articulating motion and the orientation of the rolls 26. Specifically, no machining is needed to the gear teeth 36 due to the improved filling of ring blank 14 over and between the forming elements 20 on the mandrel 12 by virtue of the parallel axial alignment between the roll axis 34 and the axis 48 of the forming elements 20 interposed between the roll 26 and the mandrel central axis a. This results in a ring gear 46 having a smooth outer surface and uniform wall thickness also not known to present gear technology unless a substantial amount of machining is performed. This also facilitates a use of the resultant ring gear 46 in high speed applications such as automotive transmissions. It is further believed that by using a plurality of rolls 26 circumferentially spaced around the ring blank 14 and simultaneously being forced radially inwardly toward the mandrel axis a improves both gear teeth 36 profiles and the uniformity of the thickness of the resultant gear 46.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method of forming a ring gear from a ring blank, comprising the steps of:

providing a mandrel having a central axis and an outer forming surface defining a plurality of forming elements each forming element having a forming element axis offset from the central axis of the mandrel;

placing the ring blank having a ring axis over the mandrel and generally aligning the central axis of the mandrel with the ring axis of the ring blank;

providing a roll having a roll axis being generally parallel with the forming element axis of the forming element interposed between the roll and the mandrel central axis; and forcing the roll radially inwardly relative to the mandrel central axis and circumscribing the mandrel central axis while rotating the roll about the roll axis thereby deforming the ring blank radially inwardly and forming a plurality of teeth with each tooth being spaced from the adjacent tooth on an inner surface of the ring blank, the formed tooth being substantially parallel with the forming element axis and angularly offset from the mandrel central axis.

2. The method set forth in claim 1, wherein said step of circumscribing the mandrel central axis is further defined by rotating the mandrel while forcing the roll radially inwardly relative to the mandrel central axis.

3. The method set forth in claim 1, further including the step of articulating the roll in a direction generally parallel to the mandrel central axis while forcing the roll radially inwardly relative to the mandrel central axis.

4. The method set forth in claim 3, wherein said step of articulating the roll in a direction generally parallel to the mandrel central axis while forcing the roll radially inwardly is further defined by articulating the roll the full extent of the ring blank.

5. The method set forth in claim 1, wherein said step of providing a roll is further defined by providing a plurality of wheels circumferentially spaced around the mandrel.

6. The method set forth in claim 1, wherein said step of providing forming elements is further defined by providing helical ribs on the outer forming surface of the mandrel.

7. The method set forth in claim 1, wherein said step of deforming the ring blank radially inwardly is further defined by decreasing an outer diameter of the ring blank by forcing the ring blank over and between the forming elements.

* * * * *